US005649813A

United States Patent [19]

Able et al.

[11] Patent Number: 5,649,813

[45] Date of Patent: Jul. 22, 1997

[54] CHAMBER INSULATION FOR PREVENTION OF ICING IN AIR MOTORS

[75] Inventors: Stephen D. Able; Douglas D. Purdy; Nicholas Kozumplik, Jr., all of Bryan, Ohio

[73] Assignee: Ingersoll-Rand Company, Woodcliff Lake, N.J.

[21] Appl. No.: 692,983

[22] Filed: Aug. 7, 1996

Related U.S. Application Data

[63] Continuation-in-part of Ser. No. 425,171, Apr. 20, 1995, abandoned.

[51] Int. Cl.[6] ..... F04G 43/06

[52] U.S. Cl. ..... 417/387; 417/389; 417/393; 417/395; 417/DIG. 1; 92/100

[58] Field of Search ..... 417/313, 387, 417/DIG. 1, 901, 389, 395, 393; 92/100

[56] References Cited

U.S. PATENT DOCUMENTS

| | | | |
|---|---|---|---|
| 862,867 | 8/1907 | Eggleston . | |
| 2,710,629 | 6/1955 | Price | 417/DIG. 1 |
| 3,128,940 | 4/1964 | McDonald | 417/DIG. 1 |
| 4,418,544 | 12/1983 | Heybutzki et al. | 417/901 X |
| 4,806,083 | 2/1989 | LaGrange et al. | 417/901 X |
| 4,854,832 | 8/1989 | Gardner et al. | 417/393 |

*Primary Examiner*—Richard E. Gluck
*Attorney, Agent, or Firm*—Walter C. Vliet; Michael M. Gnibus

[57] ABSTRACT

Insulation is provided in the form of wall insulation, piston or diaphragm insulation and/or piston rod and/or diaphragm washer insulation to increase the temperature in the working air chamber of an air motor of the piston or diaphragm type to reduce the formation of ice on exhaust.

12 Claims, 1 Drawing Sheet

CHAMBER INSULATION FOR PREVENTION OF ICING IN AIR MOTORS

This application is a continuation-in-part of application Ser. No. 08/425,171, filed Apr. 20, 1995, now abandoned.

BACKGROUND OF THE INVENTION

This invention relates generally to air motors of the piston or diaphragm type and more particularly to prevention of icing in the exhaust ports of piston and diaphragm motors for pumps and the like. Air motors often will slow down sputter or stop due to ice formation in the motor and exhaust ports during operation. In some instances elastomers in the motor can be damaged by ice formations and the movement of adjacent parts inside the motor. Low temperatures generated in the working air chamber (adjacent to a piston or diaphragm) lead to cold air being discharged through the exhaust valving into the exhaust chamber and either piped away from the pump or discharged to atmosphere through a noise silencing muffler. It is therefore desirable to minimize or eliminate the formation of ice during motor operation.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention the object of this invention is accomplished by providing chamber insulation for prevention of icing in air motors including insulating means disposed within an alternating expansion and compression chamber for conserving heat developed in the chamber during compression.

The foregoing and other aspects will become apparent from the following detailed description of the invention when considered in conjunction with the accompanying drawing figure.

BRIEF DESCRIPTION OF THE DRAWING FIGURE

FIG. 1 is a cross section of a dual diaphragm pump showing elements of the present invention on the left hand portion of the pump.

DETAILED DESCRIPTION

Figure 1:
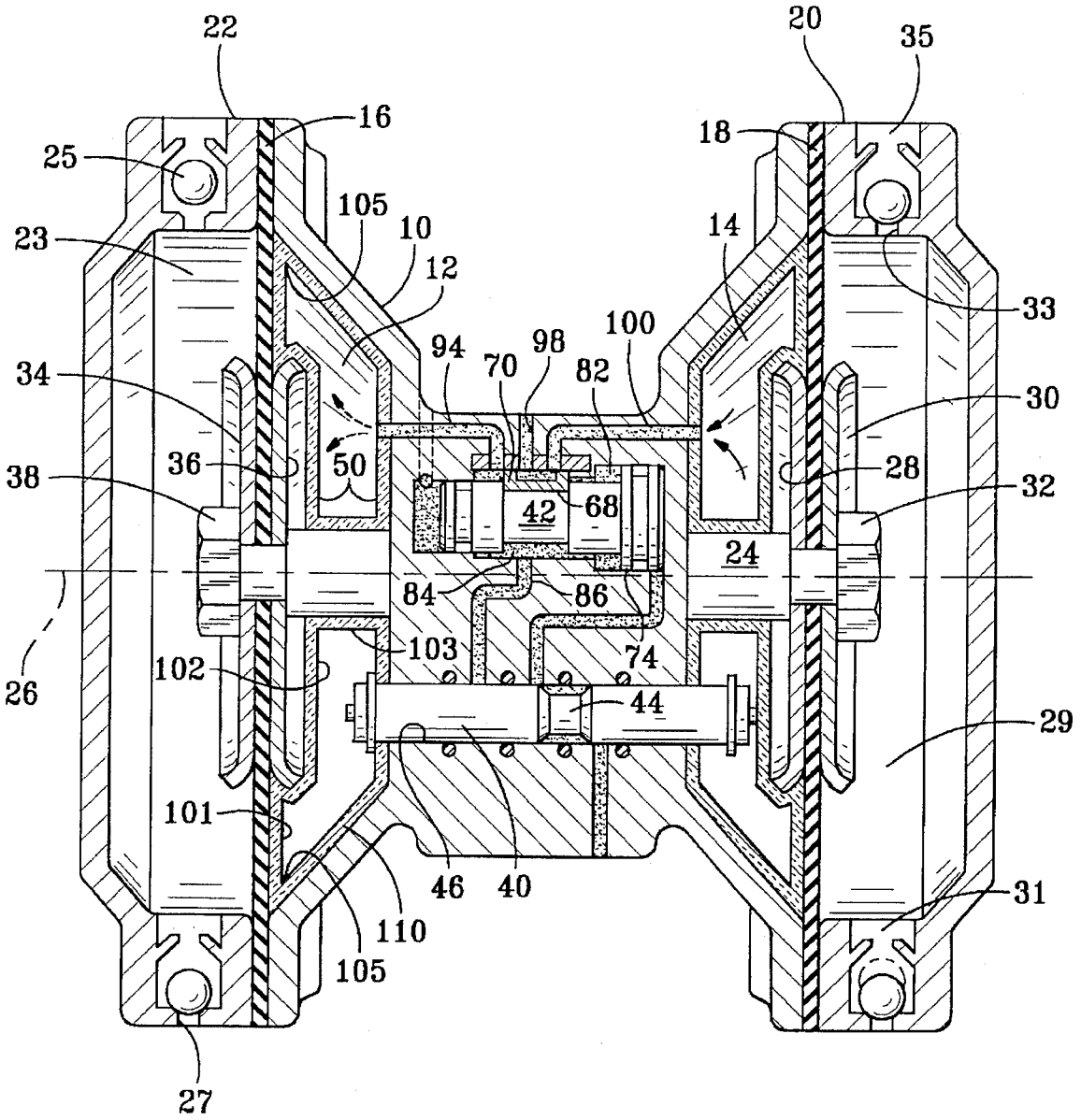

Double diaphragm pumps are known in the prior art. One such pump is shown and described in U.S. Pat. No. 4,854,832. The description and operation thereof is incorporated herein by reference and in summary may be considered as follows:

FIG. 1 illustrates a typical double diaphragm pump incorporating a mechanical shift, pneumatic assist pilot valve construction.

The pump includes a main housing 10 which defines first and second opposed axially spaced pressure chambers 12 and 14 which are substantially identical in size, shape and volume. The chambers 12 and 14 are generally conical in shape. Thus, as depicted in the cross section of FIG. 1, the cross sectional configuration for those chambers 12, 14 will generally be the same regardless of the section taken.

Associated with each chamber 12 and 14 is a flexible diaphragm 16 and 18 respectively. The diaphragms 16 and 18 are generally circular in shape and are held in position in sealing relationship with the housing 10 by an associated enclosure member 20 and 22 respectively. Thus, as depicted on the right hand side of FIG. 1, housing 10, diaphragm 18 and member 20 define a pressure chamber 14 and a pump chamber 29. Similarly, as depicted on the left side of FIG. 1, housing 10, diaphragm 16 and member 22 define a pressure chamber 12 and a pump chamber 23.

Each of the diaphragms 16 and 18 is fashioned from an elastomeric material as is known to those skilled in the art.

The diaphragms 16 and 18 are connected mechanically by means of a shaft 24 which extends axially along an axis 26 through the midpoint of each of the diaphragms 16 and 18. The shaft 24 is attached to the diaphragm 18 by means of opposed plates 28 and 30 on opposite sides thereof retained in position by a bolt 32 in shaft 24. With respect to diaphragm 16, plates 34 and 36 are retained by a bolt 38 threaded into the shaft 24. Thus, the diaphragms 16 and 18 will move axially in unison as the pump operates.

During operation the chamber 12 will initially be pressurized and the chamber 14 will be connected with an exhaust 98. This will cause the diaphragm 16 to move to the left in FIG. 1 thereby compressing fluid within a fluid chamber 23 forcing that fluid outwardly through a check valve 25. A second check valve 27 at the opposite end of chamber 23 is closed by this pumping action. Simultaneously as the diaphragm 16 moves to the left in FIG. 1, the diaphragm 18 will also move to the left. Pressurized fluid from the chamber 14 will exhaust. At that same time the fluid being pumped will enter chamber 29 through check valve 31. A second check valve 33 will be closed during this operation.

Movement of the shaft 24 in the reverse direction or to the right of FIG. 1 will reverse the pumping and filling operations of the chambers 23 and 29. In any event, flow is effected through the outlet 22 or outlet 35. Fluid flow into the pump is effected through the inlet 27 or the inlet 31.

The pilot construction includes an axially slidable mechanical pilot member or shift rod 40 and a pneumatically operated actuator 42. In the embodiment shown, the actuator 42 is also axially displaceable through the direction of movement of the valve 42 relative to the diaphragms 16, 18.

Referring to the mechanical pilot member 40, the member 40 is a generally cylindrical rod which projects through the housing 10 into the chambers 12 and 14. The member 40 includes a reduced diameter, annular groove 44 at approximately the midpoint from the ends of the member 40. The member 40 slides in a cylindrical passage 46 defined through the housing 10.

The actuator 42 is a generally cylindrical valve member having a series of different diameters so as to provide for actuation in response to pressure differential. Actuator 42 also includes an annular groove 68 which receives a sliding D-valve 70. A fluid pressure inlet 86 provides fluid pressure to operate the pump from a pressure fluid source (not shown).

In operation, air enters through the port 86 and pressurizes the chamber 84 as well as a part of the chamber 82.

As described in the referenced patent, the air is then either distributed to chamber 12 or chamber 14 depending on the position of the valve 42, the position of valve 42 being further determined by the position of shift rod member 40, as more thoroughly described in the above referenced patent through ports 94 or 100. The unpressurized chamber exhausts through the alternative of passageway 94 or 100 as controlled by the D valve 70. The exhaust air exits the pump through passageway 98.

For purposes of the present invention, it is necessary to understand that chambers 12 and 14 are alternately pressurized and exhausted through valve 42 and that in the prior art configuration, as exemplified by the right hand side of FIG. 1, icing of the valve 42 and D-valve 70 may occur during extremes of cold and damp air. According to the present invention, it has been found that conserving the heat of compression during the alternating pressurization and exhaust of the chambers will permit the temperature of the air in the chamber to be maintained at a significantly warmer level thereby minimizing ice formation on exhaust. According to the present invention, conservation of the heat of compression is accomplished by providing insulation within the motive fluid chambers 12 and 14.

The discrete insulation layer or lining generally referred to at 50 in FIG. 1 substantially lines the chamber 12. The layer of insulation 50 covers the interior portion of the wall of main housing 10 which partially defines chamber 12 and also covers the side of the flexible diaphragm 16 and plate 36 which also partially define the chamber 12. As shown in FIG. 1, the portion of the insulation layer 50 covering the interior wall of housing 10 is referred to as 110, the portion of the insulation layer covering the diaphragm 16 is referred to as 101, and the portion of the insulation layer covering plate 36 is referred to as 102. The insulation layers 101 and 110 are joined at edge 105.

The portion of the insulation layer 50 comprised of portions 101 and 102 is movable relative to the portion of the insulation 110, during operation of the pump. The portion of the insulation 50 comprised of portions 101 and 102 may also be referred to as the "movable portion" and the portion of insulation 50 comprised of portion 110 may be referred to as the "stationary portion". Therefore, the movable portion is movable relative to the stationary portion.

For purposes of clarity, it should be understood that a stationary portion like the stationary portion of chamber 12 may be included along the interior wall of the portion of the main housing 10 that defines a portion of chamber 14 and also, a movable portion like movable portion of chamber 12 may be included along diaphragm 18 and plate 28 of chamber 14. The movable and stationary portions of chamber 14 are joined at an edge like edge 105. However, for purposes of the detailed description, only the insulation layer 50 in chamber 12 will be shown and described.

The insulation lining may be unitary or may be comprised of two or more discrete pieces of insulation that are combined to form insulation layer 50. The insulation may be fixed to the housing wall, plate and diaphragm by any suitable means such as by a conventional adhesive substance or by conventional fasteners.

The movable and stationary insulation portions 101, 102 and 110 may have a uniform thickness or a variable thickness and at all times should maintain a minimum thickness of 0.03 inches and may be comprised of any suitable material having thermal conductivity rate of less than or equal to 0.10 Watt/m·°K. (at 300° K.). The most effective insulation layer and therefore the preferred material for the insulation lining 50 of the present invention has a minimum thickness of at least 0.03 inches and has a thermal conductivity value less than or equal to 0.10 Watt/m·°K. However, it should be understood that other materials with a thickness less than 0.03 inches and with a thermal conductivity value less than 0.10 may be used to line the chamber and that the thicknesses and thermal conductivity values are provided only in order to describe the preferred embodiment of the invention.

It is believed that by lining the walls of chamber 12, heat transfer is reduced. By placing the insulation layer along the interior of the chamber 12 heat transfer is impeded. If the layer of insulation was placed along the exterior of the pump housing, heat transfer out of the chamber would not be directly impeded. Heat could still be transferred out of the chamber through the housing walls. Therefore, the preferred location of the insulation lining is along the interior of the chamber.

Although the materials of construction may provide some degree of insulation, they are generally of a high density or metallic material having relatively poor heat insulation capability as opposed to, for example, a foam material. Thus, according to the present invention, a material of high insulating value, such as a polyurethane foam layer, may be applied to the internal surfaces of the chambers. A similar flexible diaphragm material may be utilized to minimize heat transfer through the diaphragms 16, 18. An insulating foam may be applied over the diaphragm plates 28 and 36 and, in addition, the shaft 24 and the shift rod 40 may be made of an insulating material or provided with an insulating sleeve 103 such as shown disposed about shaft 24.

These and other means of conserving heat within the chambers 12 and 14 may now occur to one skilled in the art and applicants do not wish to be limited in the scope of the invention except as claimed.

What is claimed is:

1. A reduced ice forming pneumatic fluid motor comprising:

a main housing having a first interior wall and a first movable partition supported by said housing, said first interior wall and first movable portion together defining a first chamber having an expandable volume, said first chamber being provided with means for receiving a compressed fluid and means for expanding said fluid to produce motive force, means for exhausting expanded fluid from said first chamber, and discrete insulation means for impeding heat transfer from said first chamber to an area outside of said first chamber to conserve heat in said first chamber, said insulation means including a stationary portion along the first interior wall and a movable portion along the movable partition, said movable portion being movable relative to said stationary portion, said movable and stationary portions being joined by an edge.

2. A reduced ice forming pneumatic fluid motor according to claim 1, wherein:

said moveable partition further comprises a flexible diaphragm.

3. A reduced ice forming pneumatic fluid motor according to claim 2, wherein:

said flexible diaphragm is a diaphragm of a diaphragm pump and said diaphragm separates said motive fluid and a pumped fluid.

4. A reduced ice forming pneumatic fluid motor according to claim 3, wherein:

said movable portion of said insulation means is comprised of a layer of flexible insulated foam.

5. A reduced ice forming pneumatic fluid motor according to claim 1, wherein:

said stationary portion of said insulating means is comprised of insulating foam.

6. A reduced ice forming pneumatic fluid motor according to claim 2 further comprising:

a means for transmitting motive force attached to said moveable partition within said first chamber and extending outside said first chamber to transmit said motive force outside said first chamber.

7. A reduced ice forming pneumatic fluid motor according to claim 6, wherein:

said means for transmitting motive force further comprises a shaft connected to said diaphragm and said shaft is provided with an insulating sleeve formed of an insulating layer, said main housing comprising a second interior wall and a second movable partition supported by said housing, said second interior wall and second movable portion together defining a second chamber having an expandable volume, said second chamber being provided with means for receiving a compressed fluid and means for expanding said fluid to produce motive force, means for exhausting expanded fluid from said second chamber, and discrete insulation means for impeding heat transfer from said second chamber to an area outside of said second chamber to conserve heat in said second chamber, said insulation means further including a stationary portion along the second interior wall and a movable portion along the second movable partition, said second movable portion being movable relative to said second stationary portion, said movable and stationary portions being joined by an edge.

8. A reduced ice forming pneumatic fluid motor according to claim 4, wherein:

said stationary and movable portions of said insulating means are each comprised of a flexible polyurethane foam material.

9. A reduced ice forming pneumatic fluid motor according to claim 5, wherein:

said stationary and movable portions of said insulating means are each comprised of a polyurethane foam material.

10. A reduced ice forming pneumatic fluid motor as claimed in claim 1 wherein said movable insulation layer and said stationary insulation layer have a thickness of at least 0.03 inches.

11. A reduced ice forming pneumatic fluid motor as claimed in claim 1 wherein said movable insulation layer and said stationary insulation layer are comprised of a material having a maximum thermal conductivity of 0.1 Watt/m·°K. at 300° K.

12. A reduced ice forming pneumatic fluid motor comprising:

a) a housing having an interior wall and a movable partition supported by said housing, said interior wall and first movable portion together defining an interior chamber having an expandable volume;

b) means for receiving a compressed fluid in said chamber;

c) means for expanding said compressible fluid to produce motive force, d) means for exhausting expanded fluid from said chamber, and e) a discrete insulation layer located along the interior of the housing, the insulation layer comprising a stationary portion along the interior wall and a movable portion along the movable partition, said movable portion being movable relative to said stationary portion, said movable and stationary portions being joined by an edge.

* * * * *